United States Patent [19]

Stöckel et al.

[11] 4,112,905

[45] Sep. 12, 1978

[54] SPARK PLUGS FOR INTERNAL COMBUSTION ENGINES

[75] Inventors: Dieter Stöckel; Friedrich Schneider, both of Pforzheim, Germany

[73] Assignee: G. Rau, Pforzheim, Germany

[21] Appl. No.: 711,683

[22] Filed: Aug. 4, 1976

Related U.S. Application Data

[63] Continuation of Ser. No. 530,500, Dec. 6, 1974, abandoned.

[30] Foreign Application Priority Data

Dec. 8, 1973 [DE] Fed. Rep. of Germany ..... 2361274

[51] Int. Cl.[2] ..... H01T 13/20

[52] U.S. Cl. ..... 123/169 EL; 313/141; 428/614

[58] Field of Search ..... 29/25.12, 191.6; 313/11.5, 11.8, 141 R, 141.1, 309, 350, 351, 357, 354; 123/169 EL, 169 E; 228/156; 148/11.5 Q, 34; 428/614

[56] References Cited

U.S. PATENT DOCUMENTS

| | | | |
|---|---|---|---|
| 1,292,659 | 1/1919 | Speed | 428/614 |
| 2,162,062 | 6/1939 | Corbin | 313/141 X |
| 2,261,436 | 11/1941 | Fanger | 29/25.14 |
| 2,391,457 | 12/1945 | Carlson | 313/11.5 |
| 2,499,977 | 3/1950 | Scott | 148/4 |
| 3,356,882 | 12/1967 | Hallauer et al. | 313/141 |
| 3,469,952 | 9/1969 | Baker | 428/614 |
| 3,864,807 | 2/1975 | Schneider et al. | 428/614 |

FOREIGN PATENT DOCUMENTS

| | | | |
|---|---|---|---|
| 566,633 | 12/1932 | Fed. Rep. of Germany | 313/141 |

*Primary Examiner*—W. Stallard

*Attorney, Agent, or Firm*—Wenderoth, Lind & Ponack

[57] ABSTRACT

A spark plug is equipped with a center electrode composed of two different metals, one of which is embedded in wire or fibre form in the other and wherein at least one of the metals possesses the properties of high electrical and thermal conductivity. The electrode is made by the joint plastic shaping of the two metals to produce a solid metallic bond therebetween. The electrode possesses the advantageous properties of good electrical and thermal conductivity, high corrosion resistance at high temperatures, slow burning rate and high mechanical strength.

17 Claims, 3 Drawing Figures

SPARK PLUGS FOR INTERNAL COMBUSTION ENGINES

This is a continuation of application Ser. No. 530,500, filed Dec. 6, 1974, now abandoned.

BACKGROUND OF THE INVENTION

This invention relates to spark plugs for use in internal combustion engines, and is particularly concerned with the construction of the centre electrode of such spark plugs.

The electrodes of spark plugs operate under very unfavourable conditions and call for compromises as regards the various properties required in the materials used therefor. On the one hand good electrical and thermal conductivity is required, while on the other hand the material should have adequate corrosion resistance, particularly at high temperatures, to the reaction products resulting from combustion of the fuel, and a very slow burning rate is necessary in order to achieve a satisfactory service life. Furthermore the workability of the material must be such as to facilitate mass production, and a sufficiently high mechanical strength at elevated temperatures is required.

A consideration of these requirements will indicate, that pure metals or alloys are generally not capable of providing a favourable combination of the required properties. Centre electrodes made up of several different metallic materials have therefore been developed. However, the known arrangements suffer from various technical disadvantages and in many cases production costs are high. The present invention seeks to provide a centre electrode made up of several different metals which while providing the best combination of the desired electrode properties is inexpensive to produce.

SUMMARY OF THE INVENTION

According to the invention there is provided a centre electrode for use in the spark plugs of internal combustion engines, which electrode comprises a length of composite material made up of at least two metals, one forming a matrix and the other being constituted by a plurality of wires or fibres embedded in the matrix, and wherein at least one of the metals possesses the properties of high electrical and thermal conductivity, the composite material being produced by the joint plastic shaping of the metals, which initially are in the form of wires, to produce a solid metallic bond therebetween.

Investigations have shown that the method used for producing the composite material decisively influences the properties of the material when in use. The composite material is therefore produced by the joint plastic shaping of the initial metals to form a solid metallic bond therebetween.

In one embodiment of the invention, the other metal takes the form of wires each having a diameter in the order of millimetres. (See Example V hereinafter).

In an advantageous embodiment, the composite material may take the form of a composite fibre reinforced material in which a large number of fibres, each having a diameter in the order of micor-meters, are embedded in the matrix metal. (See Examples 1 ot IV)

In one preferred embodiment, the fibres consist of a metal having high electrical and thermal conductivity, which fibres are embedded in a matrix metal having high corrosion resistance. In one favourable combination, the composite material comprises a matrix metal of nickel, or a nickel alloy containing at least 50% by weight of nickel, in which fibres of fine silver are embedded. In a further embodiment, the composite material includes a further initial metal of tubular shape, which forms a metal jacket around the matrix and embedded wires or fibres. Preferably, the jacket is made of corrosion resisting metal. It may also be advantageous to use thermally stable metals such as tungsten and molybdenum as the material of the fibres and/or matrix.

Advantageously, the constituents of the composite material are uniformly distributed over the cross-section of the electrode. For certain applications however, the distribution of the constituents of the composite material and particularly the disposition of the fibres in the matrix, may be other than uniform; for example a symmetrical arrangement in the form of a ring, symmetrical about a centre point, or a star-shaped distribution may be preferred.

A particular advantage may be achieved if the initial metals are solid wires. The effectiveness of the plastic shaping of the initial metals in producing a composite material in which there is a solid metallic bond between these initial metals can be confirmed by means of micrographs of the finished product, i.e. of the fully shaped centre electrode, or by any other known method.

Alternatively, the initial metals may be sheathed wires, the metal of the wire itself being one of the initial metals and the metal of the sheath the other.

By using the above-described features, it is possible to produce a centre electrode for the spark plugs of internal combustion engines that has good electrical and thermal properties combined with a slow burning rate and low production costs.

BRIEF DESCRIPTION OF THE DRAWINGS

Other featurs of the invention will become apparent from the following discussion, taken with the accompanying drawings, wherein.

DESCRIPTION OF PREFERRED EMBODIMENTS

Various examples of electrode construction in accordance with the invention will now be given:

EXAMPLE I

With reference to the drawings, a centre electrode 1 is produced from a composite fibre reinforced wire, 2 mm in diameter, contained 150 embedded fibres 3 each having a diameter of 100 μm. The composite wire comprises approximately 60% by weight of nickel as the matrix metal, 2 and 40% by weight of fine silver as the fibre metal.

Figure 1:
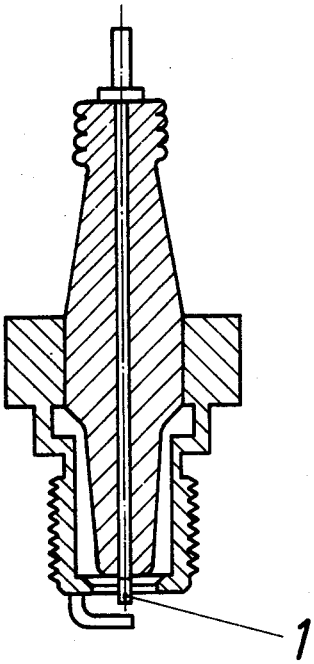
FIG. 1 is a diagramatic transverse cross-section, by way of example only, through a spark plug incorporating a centre electrode in accordance with the invention.
Figure 2:
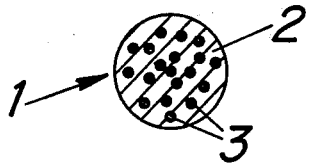
FIG. 2 is an enlarged diagramatic transverse cross-section through the sparking end of the electrode of FIG. 1 illustrating one example of electrode construction in accordance with the invention.
Figure 3:
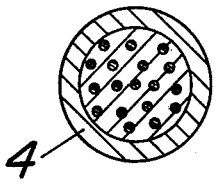
FIG. 3 is an enlarged diagramatic transverse cross-section through an electrode which additionally has therearound a surrounding jacket, preferably of corrosion-resistant material.

It will be understood that FIGS 2 and 3, being diagramatic only, do not actually illustrate all 150 fibres.

EXAMPLE II

A composite fibre reinforced wire, 2mm in diameter, for producing the centre electrodes of spark plugs, contained 50 embedded fibres each having a diameter of approximately 170 μm. The wire comprises up to 50% by weight of silver as the matrix metal, and approximately 50% by weight of a nickel alloy (made up of Ni 95%, Mn 3% and Si 2%) as the fibre metal.

EXAMPLE III

As shown in FIG. 3, a composite fibre reinforced wire, 2mm in diameter, produced in the same way as in Example II, also had a jacket 4 made of a nickel alloy as specified in Example II, the jacket having a thickness of approximately 100 μm.

EXAMPLE IV

A composite fibre reinforced wire, 2 mm in diameter, for producing the centre electrodes of spark plugs, contained 5000 embedded fibres each having a diameter of approximately 15 μm. The wire comprised 50% by weight of a nickel alloy, made up as in Example II, as the matrix metal, and approximately 50% by weight of fine silver as the fibre metal.

EXAMPLE V

A composite fibre reinforced wire formed by a plurality of solid wires comprised, in its initial condition, i.e. before joint plastic shaping was carried out, 19 pure nickel wires, 2mm in diameter, and 12 wires of fine silver; 1mm in diameter, which were distributed symmetrically over the cross-section that they formed and were put into a tubular sleeve of pure nickel having a wall-thickness of 1mm. The bunch of wires, together with the tubular sleeve, were subjected to plastic shaping by drawing, and this resulted in the wires becoming welded together in the cold state. The material was heat-treated at approximately 800° C between each two consecutive plastic shaping passes, and, by a process of diffusion, the embedded wires were bonded together with a solid metallic bond. As deformation proceeded there was formed a composite body which, at a diameter of 2mm, was used as the centre electrode of a spark plug.

We claim:

1. In an internal combustion engine spark plug of the type including a center electrode, the improvement wherein said center electrode comprises:

a length of fibre reinforced material made up of at least two metals, a first of said metals forming a matrix and a second of said metals comprising a plurality of wires or fibres embedded in and solidly metallically bonded to said matrix, at least said fibres being made up of initially solid wires, at least one of said metals of said matrix and said fibres possessing the properties of high electrical and thermal conductivity, said fibre reinforced material being produced by the joint plastic shaping of wire-shaped initial matrix and fibre metals, with at least said initial fibre metal being in the form of said solid wires.

2. The improvement claimed in claim 1, wherein said plurality of fibres comprises a large number of fibres, each having a diameter in the order of micro-meters, embedded in the matrix.

3. The improvement claimed in claim 2, wherein said fibres are made of a metal having high electrical and thermal conductivity, and wherein said matrix has high corrosion-resistance.

4. The improvement claimed in claim 3, wherein said matrix metal comprises nickel, or a nickel alloy containing at least 50% by weight of nickel, and said fibre metal comprises silver.

5. The improvement claimed in claim 1, further comprising a metallic jacket around said matrix metal and embedded wires or fibres.

6. The improvement claimed in claim 5, wherein said jacket is made of a corrosion-resistant metal.

7. The improvement claimed in claim 1, wherein said matrix metal and fibre metal are uniformly distributed over the cross-section of said electrode.

8. The improvement claimed in claim 1, wherein both said initial matrix metal and said initial fibre metal are in the form of separate solid wires.

9. The improvement claimed in claim 1, wherein the initial metals are sheathed wires, the metal of the wire itself being one of the initial metals and the metal of the sheath the other.

10. In a method for the production of an internal combustion engine spark plug, said method including fabricating a center electrode and installing said center electrode in a spark plug, the improvement wherein said center electrode is fabricated by the steps comprising:

providing wire-shaped initial metal matrix and initial metal fibres in the form of solid wires, at least one of said metals of said matrix and said fibres possessing the properties of high electrical and thermal conductivity;

bundling said matrix with said fibres distributed over the cross-section thereof; and jointly plastic shaping said matrix and said fibres to form a solid length of fibre reinforced material made up of said matrix metal having said fibre metal embedded therein and solidly metallically bonded thereto.

11. The improvement claimed in claim 10, wherein each fibre, after plastic shaping thereof, has a diameter in the order of micro-meters.

12. The improvement claimed in claim 11, wherein said fibres are of a metal having high electrical and thermal conductivity, and said matrix metal has high corrosion-resistance.

13. The improvement claimed in claim 12, wherein said matrix metal comprises nickel, or a nickel alloy containing at least 50% by weight of nickel, and said fibre metal comprises silver.

14. The improvement claimed in claim 10, wherein said matrix metal and fibre metal are bundled in a metal jacket, and said jacket is plastic shaped.

15. The improvement claimed in claim 14, wherein said jacket is made of a corrosion-resistant metal.

16. The improvement claimed in claim 10, wherein both said initial matrix metal and said initial fibre metal are in the form of separate solid wires.

17. The improvement claimed in claim 10, wherein the initial metals are sheathed wires, the wire itself comprising the fibre metal and the sheath comprising the matrix metal.

* * * * *